US005622329A

United States Patent [19]

Tominaga et al.

[11] Patent Number: 5,622,329

[45] Date of Patent: Apr. 22, 1997

[54] TERMINAL BAND FEEDING DEVICE HAVING EFFICIENT PARTITIONING TAPE DISPOSAL WHICH LIMITS TENSION IN THE TERMINAL BAND

[75] Inventors: Tomoya Tominaga; Kazuhiro Shinoda, both of Yokkaichi, Japan

[73] Assignee: Sumitomo Wiring Systems, Ltd., Mie, Japan

[21] Appl. No.: 253,316

[22] Filed: Jun. 3, 1994

[30] Foreign Application Priority Data

Jun. 11, 1993 [JP] Japan ..... 5-031461 U

[51] Int. Cl.[6] ..... B65H 77/00; B65H 23/18

[52] U.S. Cl. ..... 242/418.1; 242/564.1; 226/162; 226/150

[58] Field of Search ..... 242/418.1, 564.1, 242/594.3; 226/150, 158, 162

[56] References Cited

U.S. PATENT DOCUMENTS

| | | | |
|---|---|---|---|
| 2,737,089 | 3/1956 | Baumgartner | 242/418.1 X |
| 2,936,506 | 5/1960 | Butler, Jr. et al. | 242/418.1 X |
| 3,474,946 | 10/1969 | Desplats et al. | 226/162 X |
| 4,167,239 | 9/1979 | Bihler | 226/162 X |
| 4,253,597 | 3/1981 | Waffner | 242/418.1 X |
| 4,493,447 | 1/1985 | Ledgerwood | 226/150 |

FOREIGN PATENT DOCUMENTS

| | | |
|---|---|---|
| 63-153494 | 10/1988 | Japan . |
| 4-12442 | 1/1992 | Japan . |

*Primary Examiner*—Daniel P. Stodola
*Assistant Examiner*—Emmanuel M. Marcelo
*Attorney, Agent, or Firm*—Beveridge, Degrandi, Weilacher & Young, LLP

[57] ABSTRACT

A terminal band feeding apparatus has a feeding reel on which spirally wound are (i) a terminal band having terminal blanks in a chain manner and (ii) a partitioning tape for preventing the terminal blanks from becoming entangled with one another. By pulling out the partitioning tape from the feeding reel, the terminal band is reeled out and fed to the terminal crimping position of a continuous terminal crimping machine. When a limit switch detects the fact that predetermined tension is applied to the terminal band, the tape is clamped and sent downward by a predetermined amount. The tape thus sent is thrown away in a dust box.

10 Claims, 8 Drawing Sheets

TERMINAL BAND FEEDING DEVICE HAVING EFFICIENT PARTITIONING TAPE DISPOSAL WHICH LIMITS TENSION IN THE TERMINAL BAND

CROSS REFERENCE TO RELATED APPLICATION

This application claims priority benefits under 35 U.S.C. §119 based on Japanese Utility Model Application Serial No. 5-31461, the disclosure of which is incorporated by reference.

BACKGROUND OF THE INVENTION

1. Field of the Invention

The present invention relates to a terminal band feeding apparatus having a feeding reel on which there are spirally wound, in lamination, (i) a terminal band having, in a chain manner, terminal blanks used for electric wiring and (ii) a partitioning tape disposed on one surface of the terminal band for preventing the terminal blanks from becoming entangled with one another, the terminal band feeding apparatus being adapted to feed the terminal band by pulling out the tape from the feeding reel.

2. Description of the Related Art

In wiring electric or electronic machinery and tools, terminals are installed on wire ends with convenience for connection taken into consideration. Such terminal installation is carried out by automatically supplying a number of terminal blanks formed at regular spatial intervals by punching a band-like raw material. For the convenience of automation, the terminal blanks are to be supplied in the form of a terminal band wound on a feeding reel such that the wound terminal band has a diameter of about 500 to 700 mm. Thus, the terminal band has a number of terminal blanks formed at regular spatial intervals in the band-like raw material. Accordingly, when reeling out terminal blanks from the feeding reel, such terminal blanks are readily caught and entangled with one another. In this connection, a partitioning tape is disposed between adjacent layers of the terminal band wound on the feeding reel.

In a conventional continuous terminal crimping machine, there has been proposed a terminal band feeding apparatus in which such a partitioning tape is wound on a take-up reel and in which, by pulling out the partitioning tape from the feeding reel, the terminal band is reeled out and supplied toward the terminal crimping position of the continuous terminal crimping machine (See Japanese Utility Model Laid-Open Publication No. 4-12442)

In such a terminal band feeding apparatus using a partitioning tape, when the take-up reel is full with partitioning tape, the take-up reel is first removed from the continuous terminal crimping machine, the wound partitioning tape is then removed from the take-up reel and thrown away, and the empty take-up reel is mounted again on the continuous terminal crimping machine. However, such disposal of the partitioning tape accompanied with the removal and attachment of the take-up reel, takes much time and labor. Further, during such tape disposal, the continuous terminal crimping machine must to be stopped, causing the continuous terminal crimping machine to be lowered in working efficiency.

Meanwhile, when unnecessary tension is applied to a terminal band to be fed to the terminal crimping machine, each of the terminal blanks of the terminal band cannot be fed, as accurately positioned, to the terminal crimping machine. This increases the likelihood that a terminal is defectively crimped.

In the conventional terminal band feeding apparatus above-mentioned, a torque limiter mechanism is disposed at the take-up reel such that the partitioning tape is wound with predetermined tension applied thereto regardless of change in the winding diameter of the take-up reel. However, it is not possible to control, with high precision, the feed amount of the partitioning tape, i.e., the feed amount of the terminal band, by merely maintaining constant tension applied to the partitioning tape. Accordingly, the application of unnecessary tension to the terminal band cannot be avoided. This provokes a defective terminal crimping. It is therefore required that, with the terminal band feeding apparatus and the continuous terminal crimping machine stopped, the feeding reel is rotated by a predetermined amount in the feeding direction so as to remove unnecessary tension applied to the terminal band. This results in decrease in the working efficiency of the continuous terminal crimping machine.

SUMMARY OF THE INVENTION

It is an object of the present invention to provide a terminal band feeding apparatus capable of improving, in working efficiency, a continuous terminal crimping machine to which the terminal band feeding apparatus is applied.

To achieve the object above-mentioned, the present invention provides a terminal band feeding apparatus which is to be applied to a continuous terminal crimping machine and which is adapted to feed, to the terminal crimping position of the continuous terminal crimping machine, a long terminal band having a plurality of terminal blanks at regular spatial intervals. The terminal band feeding apparatus comprises: a feeding reel on which the terminal band and a tape are spirally wound in lamination, the tape being disposed along one surface of the terminal band; support means for rotatably supporting the feeding reel; tape feeding means for successively pulling out the tape, by a predetermined amount, from the feeding reel, such that the terminal band is fed to successively feed the terminal blanks to the terminal crimping position, and such that the pulled tape portion hangs down in a disposal container; and control means for controlling the operation of the tape feeding means.

According to the arrangement above-mentioned, the tape feeding means is arranged such that a pulled tape portion is not wound on a take-up reel but hangs down toward the disposal container disposed under the tape feeding means. This eliminates the removal/attachment of a take-up reel which has been conventionally required for disposing of the pulled tape portion. Thus, the present invention can improve the continuous terminal crimping machine in working efficiency. Further, a take-up reel which has been conventionally required, is not required any more. This results in a reduction in the space for a take-up reel which has been conventionally required.

Preferably, the present invention further comprises tension detecting means for supplying a signal when a predetermined tension is applied to that portion of the terminal band which has been reeled out from the feeding reel, and the control means is arranged such that, in response to a signal from the tension detecting means, the tape is fed by a predetermined amount to the tape feeding means.

According to the arrangement above-mentioned, when predetermined tension is applied to the terminal band, the tension detecting means supplies a signal and, upon reception of this signal, the tape feeding means feeds the tape by a predetermined pitch such that the terminal band is returned into a relaxed state. This enables the terminal band to be maintained at a predetermined relaxed state at all times. This prevents a terminal from being defectively crimped due to the application of unnecessary tension to the terminal band. Accordingly, the continuous terminal crimping machine to which the present terminal band feeding apparatus is applied, is not unnecessarily stopped, thus improving the continuous terminal crimping machine in working efficiency.

DETAILED DESCRIPTION OF THE PREFERRED EMBODIMENTS

The following will discuss in detail embodiments of the present invention with reference to the attached drawings.

Figure 1:
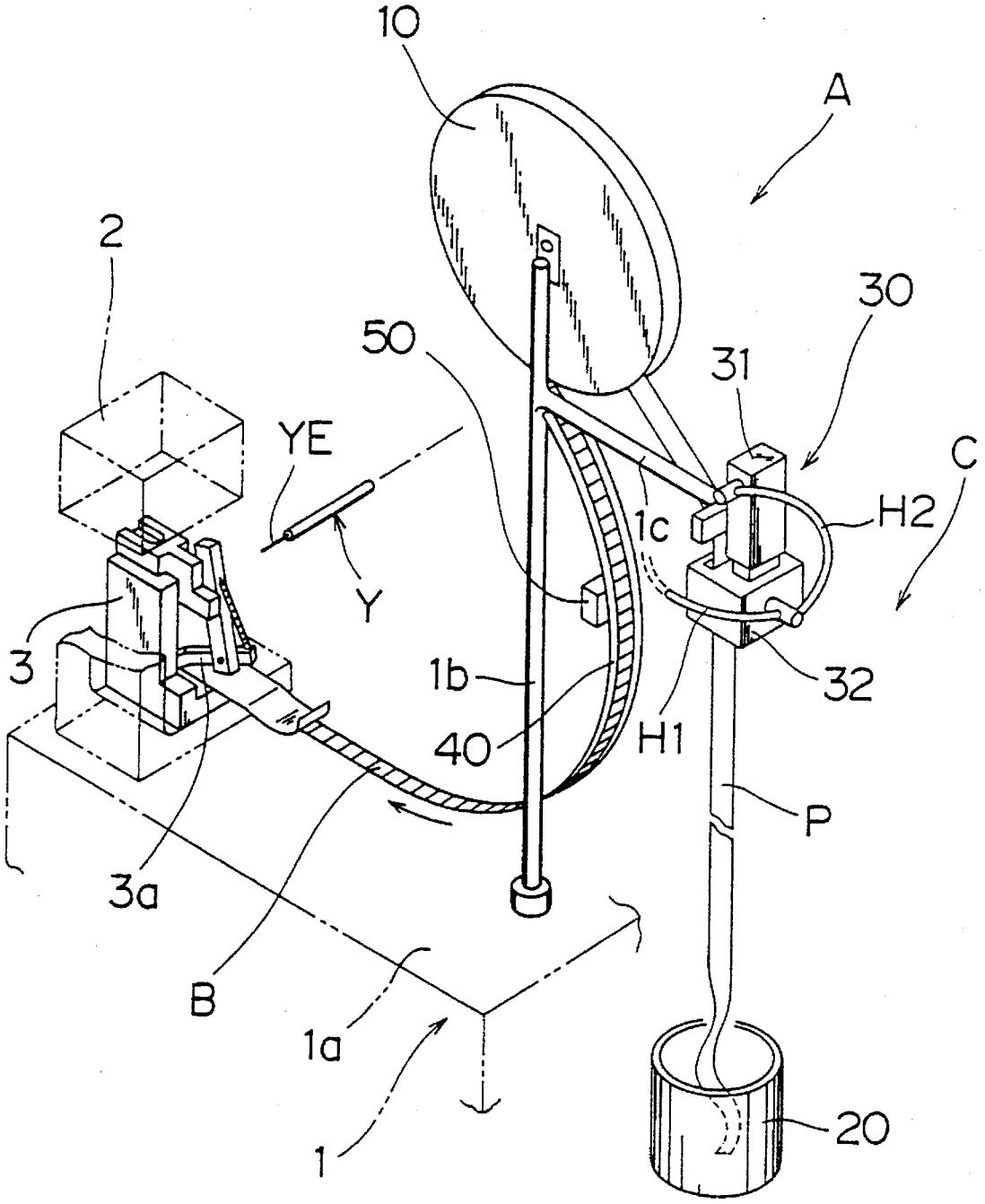
FIG. 1 is a schematic perspective view of main portions of a continuous terminal crimping machine on which a terminal band feeding apparatus is mounted according to an embodiment of the present invention.
Figures 2A, 2B, 2C:
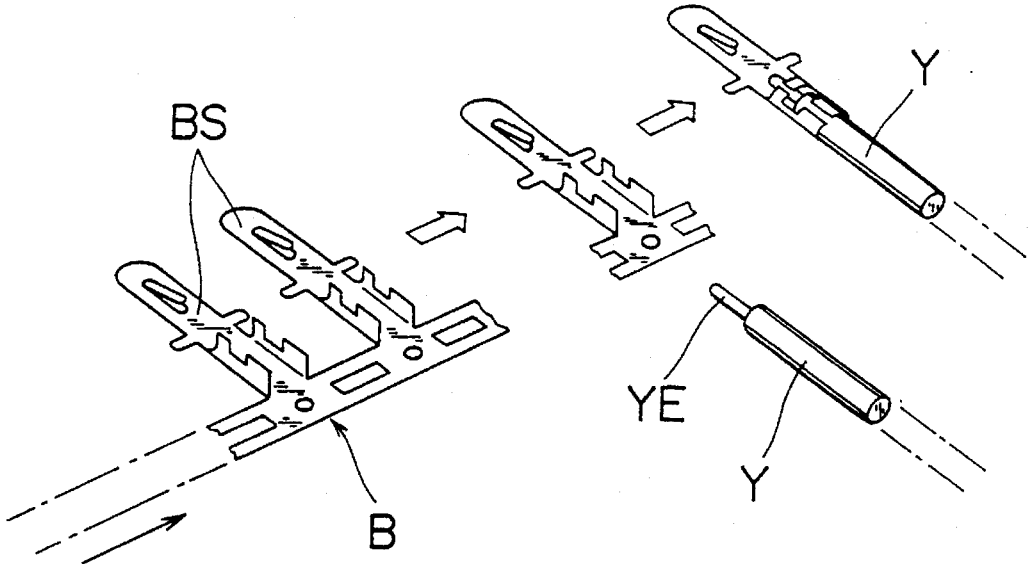
FIGS. 2A, 2B, and 2C are schematic perspective views illustrating, in succession, the terminal crimping steps.

Referring to FIG. 1, a terminal band feeding apparatus A according to the present invention is adapted to be incorporated, as a part, in a continuous terminal crimping machine 1. In this continuous terminal crimping machine 1, the terminal band feeding apparatus A feeds a terminal band B having a number of terminal blanks BS as shown in FIG. 2A, to an applicator 3 mounted on a press ram 2, and there is also supplied, to the applicator 3, an end YE of an electric wire Y with the coating layer stripped off. As shown in FIGS. 2B and 2C, each terminal blank BS is crimped to each stripped end YE of the electric wire Y and simultaneously cut and separated from the terminal band B. A pawl member 3*a* disposed at the applicator 3 is adapted to be driven in association with a vertical movement of the press ram 2. Accordingly, each time the press ram 2 is vertically moved for a crimping operation, the pawl member 3*a* hooks a predetermined portion of the terminal band B and feeds a terminal blank BS to a predetermined position (where the terminal is to be crimped).

Referring to FIG. 1, the terminal band feeding apparatus A has (i) a feeding reel 10 on which the terminal band B is wound in lamination with a partitioning tape P interposed between adjacent layers, (ii) a tape feeding mechanism 30 for pulling the tape P from the feeding reel 10, causing the tape P to hang down into a dust box 20 which is disposed under the tape feeding mechanism 30 and which serves as a disposal container, (iii) an arcuate guide plate 40 for guiding, in an arcuate manner, the terminal band B which has been reeled out from the feeding reel 10 and which is to be supplied to the applicator 3, and (iv) a tension detecting mechanism 50 disposed at an intermediate part of the arcuate guide plate 40 for supplying a signal when predetermined tension is applied to the terminal band B. The tape feeding mechanism 30 and the dust box 20 form a tape disposal device C.

The feeding reel 10 is rotatably supported by a tip of a support frame 1*b* disposed on a machine base 1*a* of the continuous terminal crimping machine 1. The support frame 1*b* integrally has, at its part nearer to the tip thereof, a T-shape bracket l*c* which extends in a lateral side of the support frame l*b*. The tape feeding mechanism 30 is attached to the tip of the T-shape bracket 1*c*.

Figure 3:
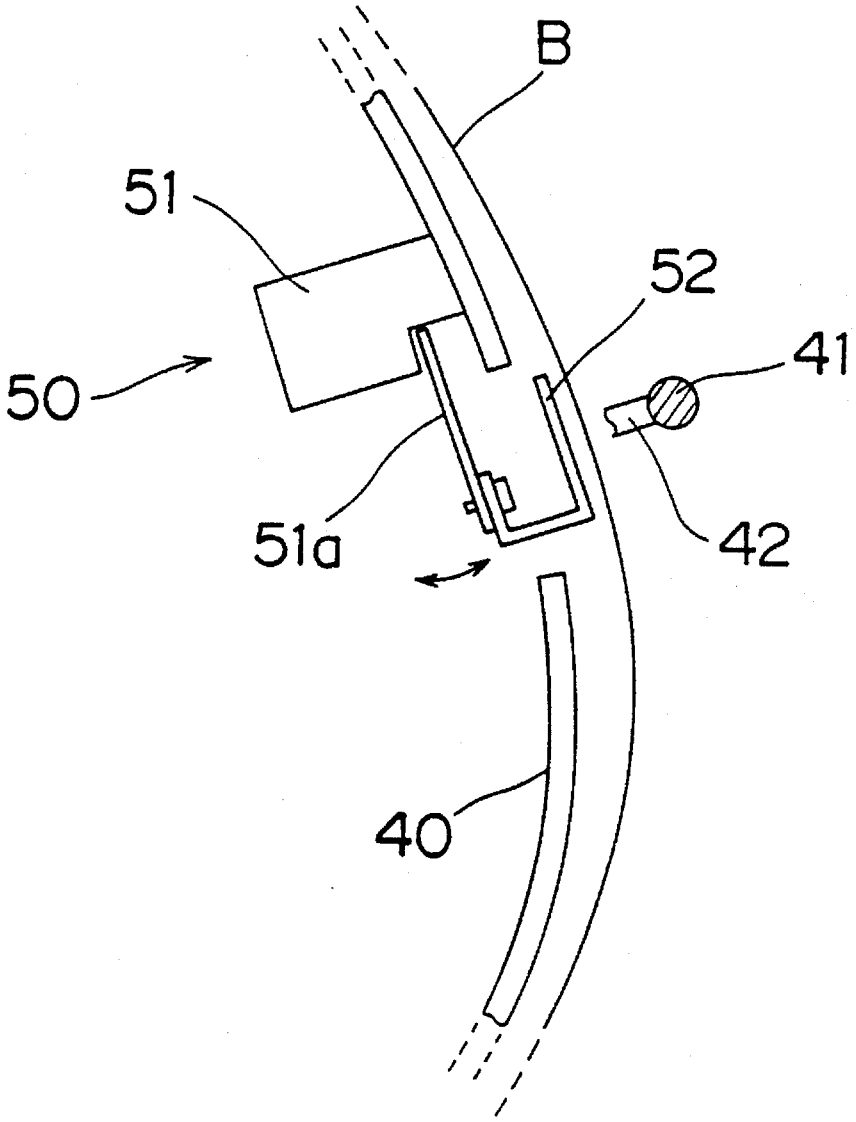
FIG. 3 is a schematic side view of a tension detecting mechanism with no tension detected.
Figure 4:
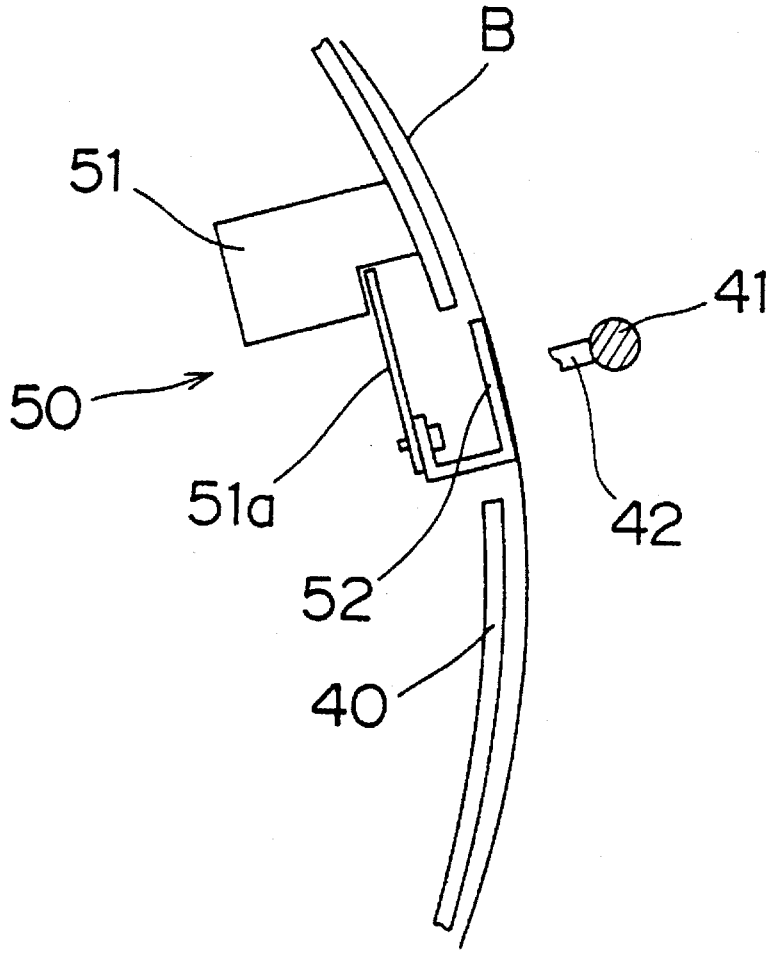
FIG. 4 is a schematic side view of the tension detecting mechanism with tension detected.

Referring to FIG. 3, the tension detecting mechanism 50 has (i) a limit switch 51 attached to the arcuate guide plate 40 at its side opposite to its side facing the terminal band B (curvature inner side) and (ii) a contact body 52 which is attached to an operating rod 51*a* of the limit switch 51 and which passes through the arcuate guide plate 40 and projects by a predetermined amount toward the terminal band B. In the tension detecting mechanism 50, when predetermined tension is applied to the terminal band B, causing the terminal band B to push the contact body 52, the limit switch 51 is turned ON, as shown in FIG. 4. An auxiliary guide rod 41 in parallel with the contact body 52 is attached to the arcuate guide plate 40 through brackets 42.

Figure 5:
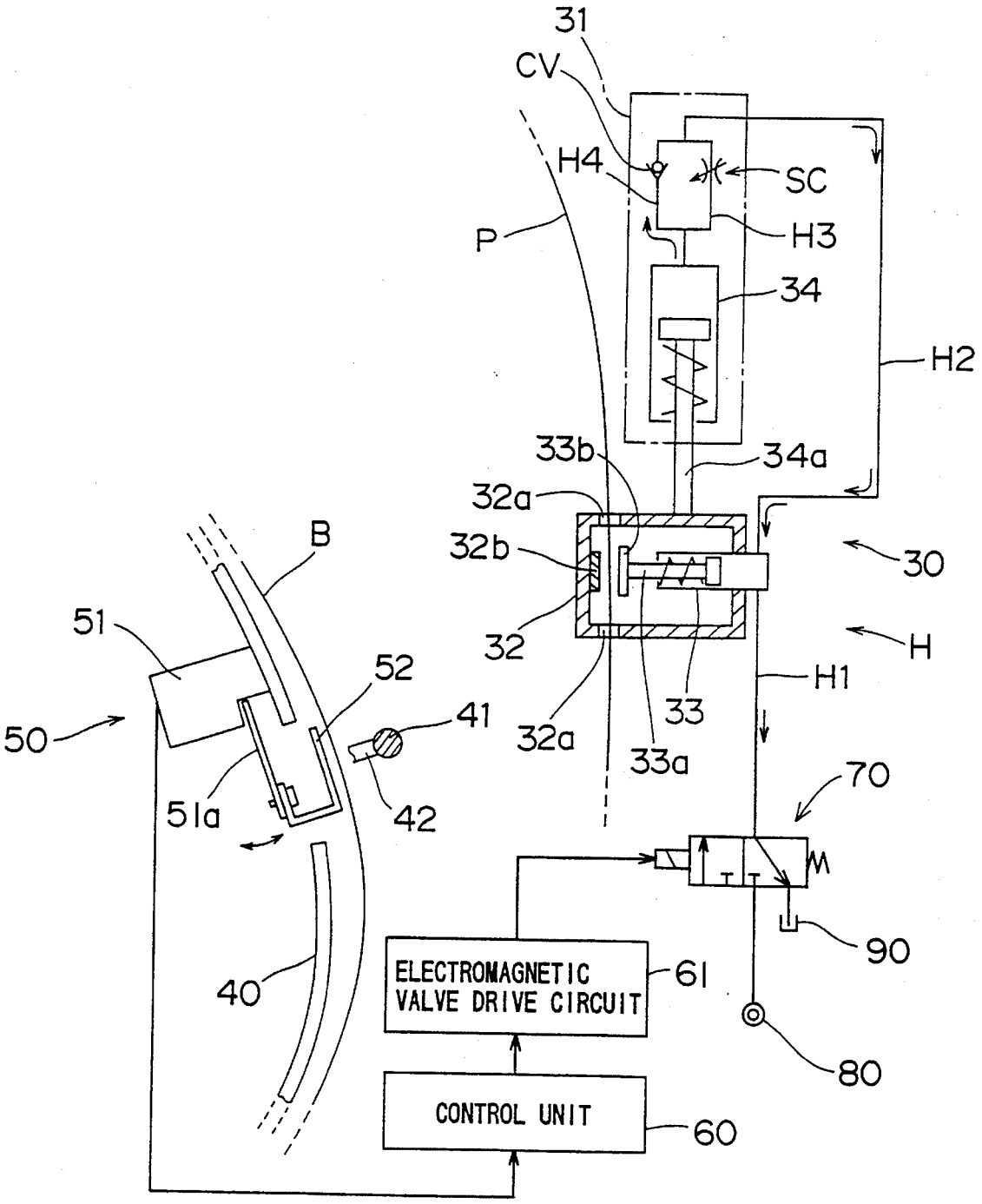
FIG. 5 is a schematic section view illustrating the inside arrangement of the tension detecting mechanism with no tension detected, and the inside arrangement of a tape feeding mechanism after a tape has been fed.
Figure 6:
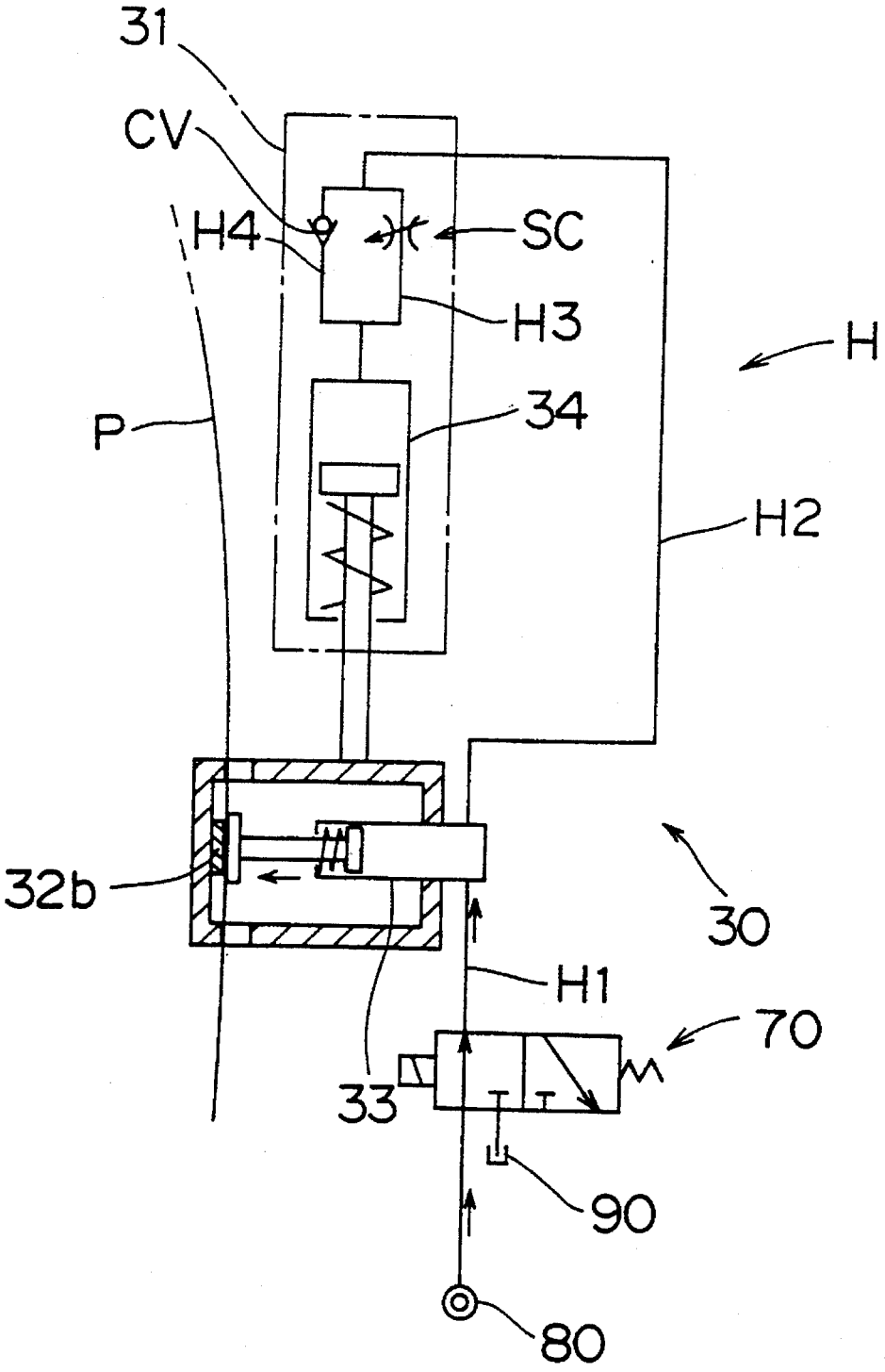
FIG. 6 is a schematic section view illustrating the inside arrangement of the tape feeding mechanism at the time when a tape is clamped.

Referring to FIGS. 1, 5, and 6, the tape feeding mechanism 30 has (i) a stationary portion 31 fixed to the bracket 1*c* and (ii) a movable portion 32 vertically slidable with respect to the stationary portion 31. The movable portion 32 has a pair of insertion holes 32*a* through which the tape P passes, and incorporates a clamping cylinder 33 comprising a single-acting air cylinder with a spring. In the clamping cylinder 33, a clamp plate 33*b* is secured to the end of a rod 33*a* of the cylinder 33. As shown in FIG. 6, the tape P passing through the insertion holes 32*a* is clamped between a rubber member 32*b* secured to the inside of the movable portion 32 and the clamp plate 33*b* by extension of the rod 33*a*.

The stationary portion 31 incorporates a tape feeding cylinder 34 which comprises a single-acting air cylinder with a spring and which has a rod 34*a* integrally movably attached to the movable portion 32. Air is adapted to be supplied to the cylinders 33 and 34 through a single-system air supply passage H. The single-system air supply passage H includes (i) a first air supply passage H1 extending from an air supply source 80 such as an air pump or the like to the clamping cylinder 33, and (ii) a second air supply passage H2 extending from the clamping cylinder 33 to the tape feeding cylinder 34.

A direction control valve 70 of the electromagnetic type (hereinafter simply referred to as the electromagnetic valve 70) is disposed in the middle course of the first air supply passage H1. The electromagnetic valve 70 can take two positions, i.e., a first position where the air supply source 80 is connected to the clamping cylinder 33, thus allowing air to be supplied to the clamping cylinder 33 as shown in FIG. 6, and a second position where the air supply source 80 is disconnected from the clamping cylinder 33 and where the clamping cylinder 33 is connected to a drain 90.

Figure 7:
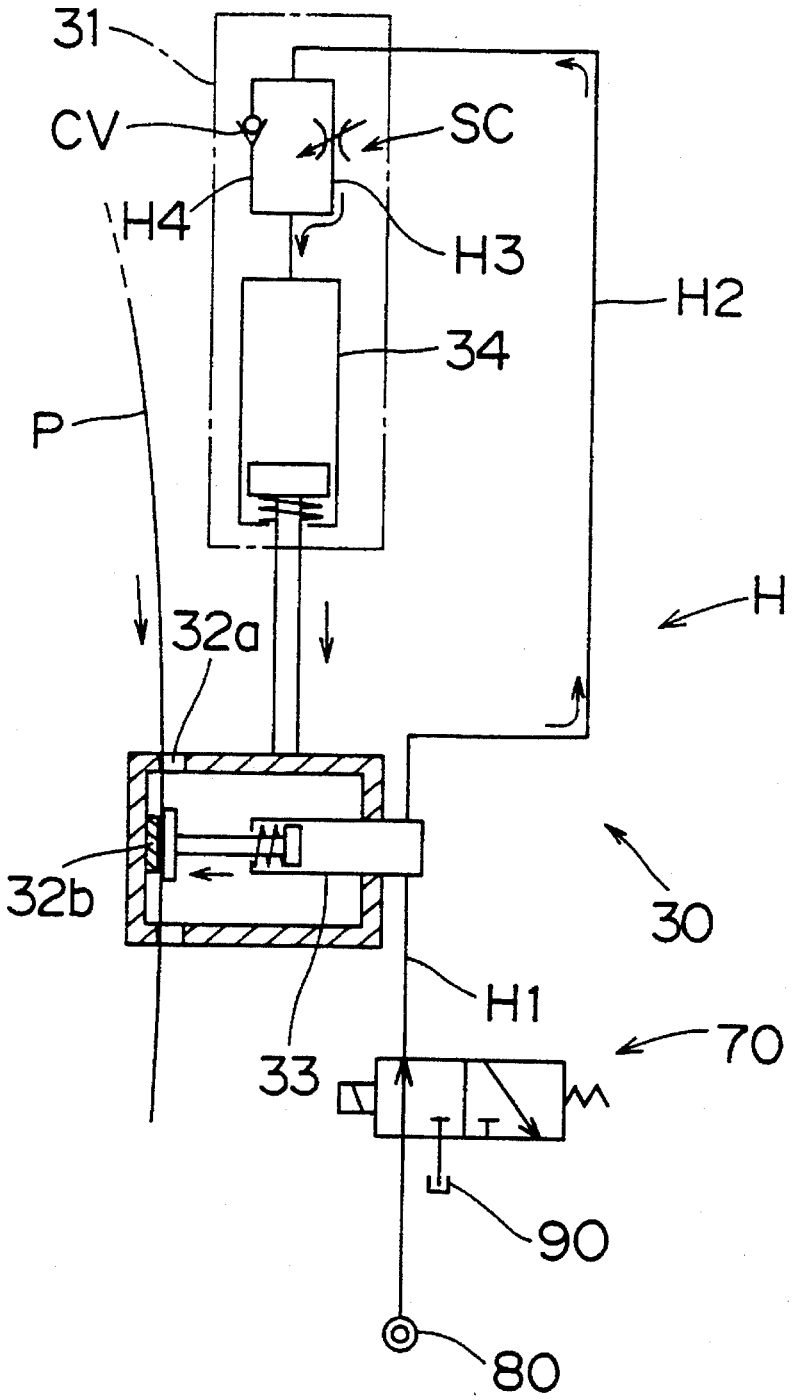
FIG. 7 is a schematic section view illustrating the inside arrangement of the tape feeding mechanism at the time when a tape as clamped is fed.

The second air supply passage H2 includes, in the middle course thereof, a third air supply passage H3 and a fourth air supply passage H4 which are parallel to each other. Disposed in the third air supply passage H3 is a flow amount control valve SC for adjusting the speed at which air is supplied to the tape feeding cylinder 34. Disposed in the fourth air supply passage H4 is a check valve CV which prevents air from being supplied to the tape feeding cylinder 34 and which allows air to be discharged from the tape feeding cylinder 34. In FIG. 5, an arrow marked along the air supply passage H represents the direction of air flow at the time of air discharge. In FIGS. 6 and 7, an arrow marked along the air supply passage H represents the direction of air flow at the time of air supply.

The limit switch 51 of the tension detecting mechanism 50 is connected to a control unit 60 comprising a microcomputer or the like. The control unit 60 is connected to an electromagnetic-valve drive circuit 61 for driving the electromagnetic valve 70. When a signal, representing that the limit switch 51 is turned ON is supplied to the control unit 60, the control unit 60 operates in response to the ON signal such that the electromagnetic valve 70 is switched to the first state for a predetermined period of time (e.g., 2 seconds). Accordingly, air is supplied to the cylinders 33 and 34 of the tape feeding mechanism 30, so that the tape P is pulled out by a predetermined amount from the feeding reel 10.

The following description will discuss the operation of the tape feeding mechanism 30. When the tape feeding mechanism 30 receives air from the air supply source 80 according to the detection of tension of the terminal band B by the tension detecting mechanism 50, the clamping cylinder 33 is first operated as shown in FIG. 6 so that the tape P is clamped. When, with the tape P clamped, the tape feeding cylinder 34 is then operated to downwardly slide the movable portion 32 in its entirety as shown in FIG. 7, the tape P is pulled out from the feeding reel 10 by a predetermined amount (which corresponds to a stroke of the tape feeding cylinder 34 and which can be set, for example, to about 15 mm). The tape P thus pulled out is sent to the dust box 20 disposed under the tape feeding mechanism 30, and the terminal band B is fed by an amount corresponding to the tape feed amount. Then, as shown in FIG. 5, air is discharged from the cylinders 33 and 34, causing the clamp of the tape P to be released, and the coil spring incorporated in the cylinder 34 causes the movable portion 32 to be returned to the original position, thus completing one tape-feeding operation. The tape feeding mechanism 30 is arranged such that, for example, three tape-feeding operations are carried out in response to one tension detection.

According to the present invention, the tape P pulled out is not wound on a take-up reel, but it can hang down in the dust box 20 disposed under the tape feeding mechanism 30. This eliminates the operation of attachment/removal of a take-up reel which has been conventionally required for disposing of the tape P. This results in improvement in working efficiency of the continuous terminal crimping machine 1. Further, a conventionally required space for a take-up reel can be reduced. Moreover, the present invention can be simplified in structure since an air supply system for the cylinder 33 and an air supply system for the cylinder 34 are integrated in a single system.

According to the present invention, the terminal band B can always be maintained in a predetermined relaxed state. This prevents a terminal blank BS which is about to reach the terminal crimping position, from being pulled by that portion of the terminal band B which is located rearward with respect to the terminal blank BS. This prevents a terminal from being defectively crimped. Conventionally, if a terminal is defectively crimped, the continuous terminal crimping machine has to be stopped. According to the embodiment above-mentioned, however, such defective crimping can be eliminated. This prevents the continuous terminal crimping machine from being unnecessarily stopped, thus improving the working efficiency thereof.

Figure 8:
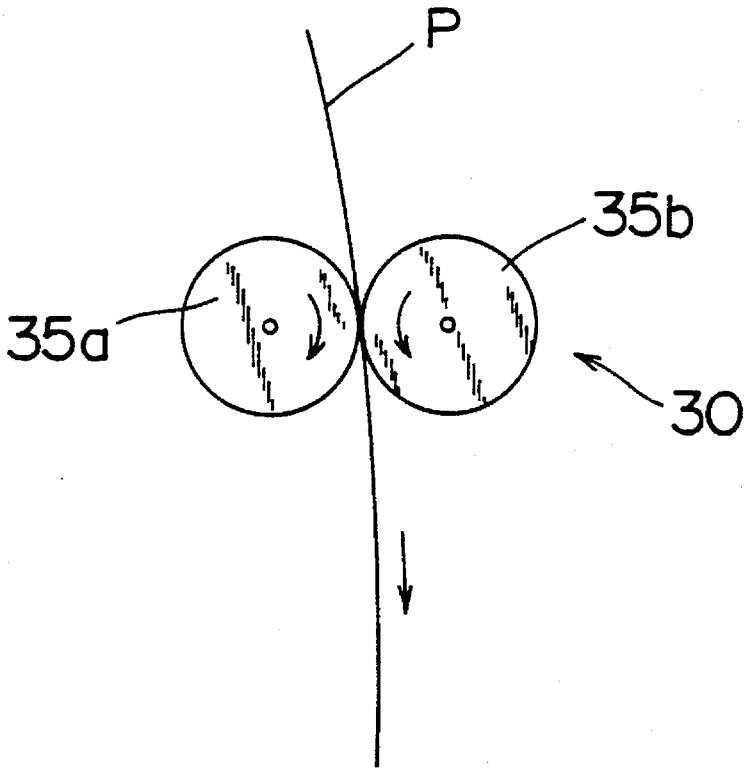
FIG. 8 is a schematic view of another example of the tape feeding mechanism.

In the embodiment above-mentioned, the tape feeding mechanism is of the air cylinder type, but may be of the hydraulic cylinder type. Further, a tape feeding mechanism of the rubber roller type may be used in which the tape P is fed as held by and between a pair of rotary rubber rollers 35*a*, 35*b*, as shown in FIG. 8. Also, a continuous terminal crimping machine of the gear type may be used in which a tape is fed as held by and between a pair of rotary gears while the tape is broken through.

Further, as the tape P, paper or synthetic paper may be used. In addition, the present invention may be modified in a variety of manners without departing from the spirit or essential characteristics thereof.

What is claimed is:

1. In combination, a terminal band feeding apparatus and a continuous terminal crimping machine, said terminal band feeding apparatus feeding, to a terminal crimping position of the continuous terminal crimping machine, a long terminal band having a plurality of terminal blanks at regular spatial intervals, the terminal band feeding apparatus comprising:

a feeding reel on which the terminal band and a tape are spirally wound in lamination, said tape being disposed along one surface of said terminal band;

support means for rotatably supporting said feeding reel;

tape feeding means for successively pulling out said tape, by a predetermined amount, from said feeding reel such that said terminal band is fed to successively feed said terminal blanks to the terminal crimping position and such that the pulled tape hangs down under its own weight to be received in a disposal container; and control means for controlling the operation of said tape feeding means, wherein a portion of said terminal band which has been reeled out from said feeding reel and which is located between said feeding reel and said terminal crimping position is maintained in a predetermined relaxed state; and tension detecting means adapted to supply a signal when a predetermined tension is applied to the portion of said terminal band which has been reeled out from said feeding reel, said control means being adapted to activate said tape feeding means to feed a predetermined amount of said tape in response to said signal from said tension detecting means, and wherein the portion of said terminal band which is located between said feeding reel and said terminal crimping position is arranged in an arcuate manner;

an arcuate guide surface is disposed opposite to an inner surface of said terminal band portion arranged in said arcuate manner, a predetermined distance being formed between said arcuate guide surface and said inner surface of said terminal band portion; and said tension detecting means is adapted to detect a condition in which said terminal band portion essentially contacts said arcuate guide surface; and wherein the tape feeding means includes:

a stationary portion secured to a stand;

a movable portion movable relative to said stationary portion;

a clamping mechanism disposed at said movable portion for releasably clamping the tape;

reciprocatingly moving means for reciprocatingly moving said movable portion vertically between an upper position and a lower position, said reciprocatingly moving means moving said movable portion from said upper position to said lower position when said clamping mechanism clamps the tape, the tape being fed downwardly, and said moving means moving said movable portion from said lower position to said upper position when said clamping mechanism does not clamp the tape, the tape thereby hanging to prevent the tape from returning in a direction opposite to the feed direction thereof; and drive means for driving said clamping mechanism.

2. A combination according to claim 1, wherein said drive means includes a first fluid-pressure cylinder, and said reciprocatingly moving means includes a second fluid-pressure cylinder.

3. A combination according to claim 2, further comprising:

a first passage through which a fluid from a pressure source is supplied to said first fluid-pressure cylinder;

a second passage for connecting said first fluid-pressure cylinder to said second fluid-pressure cylinder;

an electromagnetic valve disposed at said first passage; and a flow amount control valve disposed in said second passage, and wherein said control means is adapted to supply a signal for driving said electromagnetic valve, based on a signal supplied from said tension detecting means.

4. A combination according to claim 3, wherein the control means is adapted to supply said signal for driving said electromagnetic valve a plurality of times in response to the signal from said tension detecting means.

5. A combination according to claim 1, wherein said tension detecting means includes a limit switch.

6. A terminal band feeding apparatus for supplying terminal blanks to a terminal crimping position of a terminal crimping machine, comprising:

a feeding reel on which the terminal band and a partitioning tape are wound in lamination, the partitioning tape being disposed along one surface of the terminal band;

support means for rotatably supporting said feeding reel;

tape feeding means for successively pulling out a predetermined amount of the partitioning tape from the feeding reel such that said terminal blanks are fed successively to the terminal crimping position and such that the partitioning tape hangs down under its own weight to a disposal container;

control means for controlling the tape feeding means, wherein a portion of said terminal band which has been reeled out from said feeding reel and which is located between said feeding reel and said terminal crimping position is maintained in a predetermined relaxed state; and tension detecting means adapted to supply a signal when a predetermined tension is applied to the portion of said terminal band which has been reeled out from said feeding reel, said control means is adapted to activate said tape feeding means to feed a predetermined amount of said tape in response to said signal from said tension detecting means, and wherein the portion of said terminal band which is located between said feeding reel and said terminal crimping position is arranged in an arcuate manner;

an arcuate guide surface is disposed opposite to an inner surface of said terminal band portion arranged in said arcuate manner, a predetermined distance being formed between said arcuate guide surface and said inner surface of said terminal band portion; and said tension detecting means is adapted to detect a condition in which said terminal band portion essentially contacts said arcuate guide surface; and wherein the tape feeding means includes:

a stationary portion secured to a stand;

a movable portion movable with respect to the stationary portion;

a clamping mechanism disposed at the movable portion for releasably clamping the partitioning tape;

moving means for moving the movable portion with respect to the stationary portion vertically between an upper position and a lower position, said moving means moving said movable portion from said upper position to said lower position when said clamping mechanism clamps the tape, the tape being fed downwardly, and said moving means moving said movable portion from said lower position to said upper position when said clamping mechanism does not clamp the tape, the tape thereby hanging to prevent the tape from returning in a direction opposite to the feed direction thereof; and drive means for driving the clamping mechanism.

7. A terminal band feeding apparatus according to claim 6, wherein the tension detecting means includes a limit switch.

8. A terminal band feeding apparatus according to claim 6, wherein the drive means includes a first fluid-pressure cylinder, and the moving means includes a second fluid-pressure cylinder.

9. A terminal band feeding apparatus according to claim 8, further comprising:

a first passage through which a fluid from a pressure source is supplied to the first fluid-pressure cylinder;

a second passage for connecting the first fluid-pressure cylinder to the second fluid-pressure cylinder;

an electromagnetic valve disposed at the first passage; and a flow amount control valve disposed in the second passage, wherein the control means supplies a signal for driving the electromagnetic valve based on a signal supplied from the tension detecting means.

10. A terminal band feeding apparatus according to claim 9, wherein the signal for driving the electromagnetic valve is supplied a plurality of times in response to the signal from the tension detecting means.

* * * * *